US006585590B2

(12) United States Patent
Malone

(10) Patent No.: US 6,585,590 B2
(45) Date of Patent: Jul. 1, 2003

(54) METHOD AND SYSTEM FOR OPERATING A BINGO GAME ON THE INTERNET

(75) Inventor: Perry Malone, Oakville (CA)

(73) Assignee: Dotcom Entertainment Group, Inc., Oakville (CA)

( * ) Notice: Subject to any disclaimer, the term of this patent is extended or adjusted under 35 U.S.C. 154(b) by 48 days.

(21) Appl. No.: 09/802,876

(22) Filed: Mar. 12, 2001

(65) Prior Publication Data

US 2002/0137562 A1 Sep. 26, 2002

(51) Int. Cl.[7] ..... A63F 9/24
(52) U.S. Cl. ..... 463/19; 463/42
(58) Field of Search ..... 463/16–20, 40, 463/41, 42; 273/269, 274

(56) References Cited

U.S. PATENT DOCUMENTS

| | | | | |
|---|---|---|---|---|
| 4,332,389 A | * | 6/1982 | Loyd, Jr. et al. | |
| 4,365,810 A | | 12/1982 | Richardson | 273/237 |
| 4,651,995 A | * | 3/1987 | Henkel | |
| 4,661,906 A | * | 4/1987 | DiFrancesco et al. | |
| 4,760,527 A | | 7/1988 | Sidley | 364/412 |
| 4,848,771 A | | 7/1989 | Richardson | 273/237 |
| 4,909,516 A | * | 3/1990 | Kolinsky | |
| 4,926,327 A | | 5/1990 | Sidley | 364/412 |
| 5,007,649 A | | 4/1991 | Richardson | 273/237 |
| 5,043,887 A | | 8/1991 | Richardson | 364/410 |
| 5,072,381 A | | 12/1991 | Richardson et al. | 364/410 |
| 5,096,202 A | * | 3/1992 | Hesland | |
| 5,297,802 A | * | 3/1994 | Pocock et al. | |
| 5,351,970 A | | 10/1994 | Fioretti | 273/439 |
| 5,569,083 A | | 10/1996 | Fioretti | 463/19 |
| 5,679,077 A | * | 10/1997 | Pocock et al. | |
| 5,695,400 A | * | 12/1997 | Fennell, Jr. et al. | |
| 5,830,069 A | | 11/1998 | Soltesz et al. | 463/42 |
| 5,857,911 A | | 1/1999 | Fioretti | 463/40 |
| 5,951,396 A | * | 9/1999 | Tawil | |
| 6,012,984 A | * | 1/2000 | Roseman | |
| 6,257,980 B1 | * | 7/2001 | Santini, Jr. | |
| 6,280,325 B1 | * | 8/2001 | Fisk | |
| 6,360,038 B1 | * | 10/2001 | Graves et al. | |

FOREIGN PATENT DOCUMENTS

| | | | |
|---|---|---|---|
| EP | 0 867 209 A1 | 9/1998 | A63F/3/06 |

* cited by examiner

*Primary Examiner*—Michael O'Neill
(74) *Attorney, Agent, or Firm*—Henderson, Neil, Fasken, Martineau, DuMoulin LLP

(57) ABSTRACT

The present invention provides a method of operating a bingo game using a game server on a network, comprises (a) providing a plurality of unique game cards and enabling a plurality of players to each purchase at least one unique game card by using a remote game client computer, at least one purchased card is a winning game card; (b) suspending the purchase of game cards; (c) after step (b), generating numbers to obtain a sequence of calls; (d) applying the sequence of calls to each purchased game card and identifying the at least one winning game card; (e) after step (d), transmitting the sequence of calls applied in step (d) to each remote game client computer which has been used to purchase at least one game card; and, (f) on each remote game client computer, repeating the sequence of calls applied in step (d) until the at least one winning game card is identified.

14 Claims, 6 Drawing Sheets

METHOD AND SYSTEM FOR OPERATING A BINGO GAME ON THE INTERNET

FIELD OF THE INVENTION

This invention relates to a method and system for operating a bingo game on the internet.

BACKGROUND OF THE INVENTION

In the prior art, various methods and systems for playing bingo over a wide geographic area have been proposed.

In U.S. Pat. No. 5,351,970, issued to Fioretti, there is shown and described a system for enabling bingo to be played over a wide geographic area. The system described in Fioretti '970 comprises means for issuing game card arrays in response to purchase requests (this means includes a point of sale terminal and a system base station means for issuing valid game card arrays); means for keeping track of all game card arrays issued in response to the purchase requests; means for sequencing through each bingo game on a scheduled bingo session; and means for communicating over a wide geographic area the sequence of random symbols being generated during a particular bingo game. This method enables players over a wide geographic area to participate in a bingo session.

In U.S. Pat. No. 5,569,083, which also issued to Fioretti, there is shown and described a system and method for playing bingo over a wide geographic area, comprising: an on-line point of sale terminal means for issuing valid game card arrays; means for keeping track of all game card arrays; means for sequencing through each bingo game in a scheduled bingo session; and means for communicating over a wide geographic area the sequence of random symbols being generated during a particular bingo game. In alternative embodiments, the system of Fioretti '083 further provides a communication path for allowing a game participant to interact with the system.

U.S. Pat. No. 5,857,911, which again issued to Fioretti, shows and describes a method and system for enabling bingo and similar games of chance to be played in real time at locations which are geographically separated from the locations where the numbers used to play a bingo type of game are being selected.

In U.S. Pat. No. 5,830,069, which issued to Solteaz et al., there is shown and described a system comprising a central site PC with gaming control controlling a gaming event, a private Wide Area Network ("WAN") connected to the central site PC, and at least one participation site with at least one participant and a participation site PC. Each cental site PC communicates video and non-video information of the gaming event to each participation site PC through the WAN. Furthermore, each participation site PC communicates information regarding the participation of the participants in the gaming event to the central site PC through the WAN.

While the prior art methods and systems teach how the game of bingo and similar games of chance can be played interactively over a wide geographic area, one disadvantage is that they fail to address the problem of ensuring fairness for all players playing the game when some players have an unfair advantage in terms of network connection speed and access.

SUMMARY OF THE INVENTION

In one aspect, the present invention provides a method of operating a bingo game using a game server on a network and a plurality of remote game client computers, comprising:

(a) providing a plurality of unique game cards and enabling a plurality of players to each purchase at least one unique game card by using a remote game client computer, at least one purchased card is a winning game card;

(b) suspending the purchase of game cards;

(c) after step (b), generating numbers to obtain a sequence of calls;

(d) applying the sequence of calls to each purchased game card and identifying the at least one winning game card;

(e) after step (d), transmitting the sequence of calls applied in step (d) to each remote game client computer which has been used to purchase at least one game card; and, (f) on each remote game client computer, repeating the sequence of calls applied in step (d) until the at least one winning game card is identified.

In one embodiment, the method further includes the step of including with the transmitted sequence of calls the identity of the at least one winning game card.

In another embodiment, the method further includes the step of coding the sequence of calls and the identity of the at least one winning game card prior to transmitting said sequence of calls and identity of the at least one winning game card to each remote client computer.

In another embodiment, the method further includes the step of coding the sequence of calls prior to transmitting said sequence of calls to each remote client computer.

In yet another embodiment, step (f) comprises repeating each number in the sequence of calls at specified intervals until the at least one winning game card is called.

In another embodiment, in step (e), the transmitting of the sequence of calls and the identity of the at least one winning game to said remote game client computers is asynchronous.

In another embodiment, the method further comprises the step of synchronizing the start of the sequence of calls on said remote game client computers with a start signal issued by the game server.

In yet another embodiment, in step (e), the transmitting of the sequence of calls to said remote game client computers is asynchronous.

In another embodiment, the method further includes the step of synchronizing the start of the sequence of calls on said remote game client computers with a start signal issued by the game server.

In another embodiment, the method further includes the step of selecting a game pattern and generating a plurality of game cards.

In another embodiment, the plurality of game cards are first generated before the purchase of the cards is enabled.

In yet another embodiment the game cards are generated as they are purchased.

In another aspect, the present invention provides a system for simulating a real time bingo game on a network, including a game server connected to a network and comprising:

(i) a purchase order processor for processing purchase orders for game cards from remote game client computers;

(ii) a generator for generating a sequence of calls;

(iii) a processor for applying the sequence of calls to purchased game cards and determining at least one winning game card; and (iv) a network connection for transmitting at the same time the sequence of calls to at least one remote game client computer.

In one embodiment, the system further includes a storage device for storing at least one of said purchased game cards, said sequence of calls, and the at least one winning game card information.

BRIEF DESCRIPTION OF THE DRAWINGS

For a better understanding of the present invention, and to show more clearly how it may be carried into effect, reference will now be made, by way of example, to the accompanying drawings which show a preferred embodiment of the present invention, and in which.

DETAILED DESCRIPTION OF THE INVENTION

As mentioned, the present invention provides a method and a system for operating a bingo game on the internet in a manner that is fair to all of the players playing a game.

Figure 1:
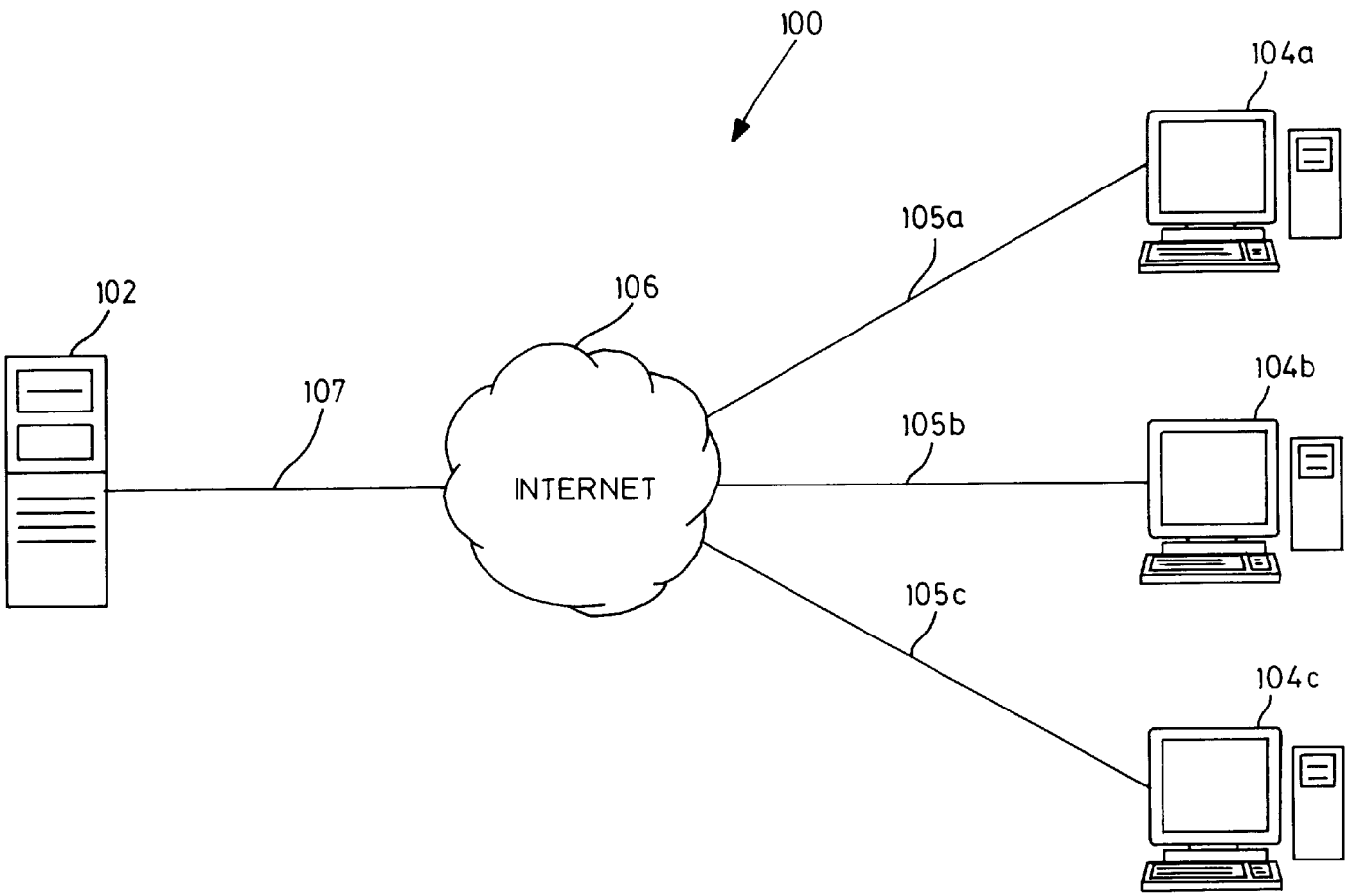
FIG. 1 shows a schematic diagram of an embodiment of a system for operating a bingo game in accordance with the present invention.

FIG. 1 shows a schematic diagram of a bingo game system in accordance with the present invention, indicated generally by reference numeral 100. Shown in FIG. 1 is a game server 102 and a plurality of remotely located game client computers 104*a*–104*c*, all connected over a computer network, such as by the internet 106. As will be understood, the game client computer connections 105*a*–105*c* to the internet 106 can be facilitated by any one of a number of different connection types including, but not limited to, wireless, dial-up modem, DSL, ADSL, cable, T1, T3, etc. As will be understood, the connection speeds vary greatly between, say, dial-up modems connected at a typical speed of 56 kbps, and a T1 connection with a speed of 1 Mbps. Furthermore, depending on the geographic location of the game client computers 104*a*–104*c*, and the reliability of their local internet service provider ("ISP"), access to the internet 106 and to the game server 102 can be interrupted, or very slow. While the game server 102 can be connected to the internet 106 by a high speed network connection 107 to provide good server performance, the variability in connection speed and reliability of the connections 105*a*–105*c* between the remote game client computers 104*a*–104*c* and the internet 106 can make a game of chance and speed such as bingo fundamentally unfair when played on the internet. The present invention provides a novel solution to this problem.

Figure 2:
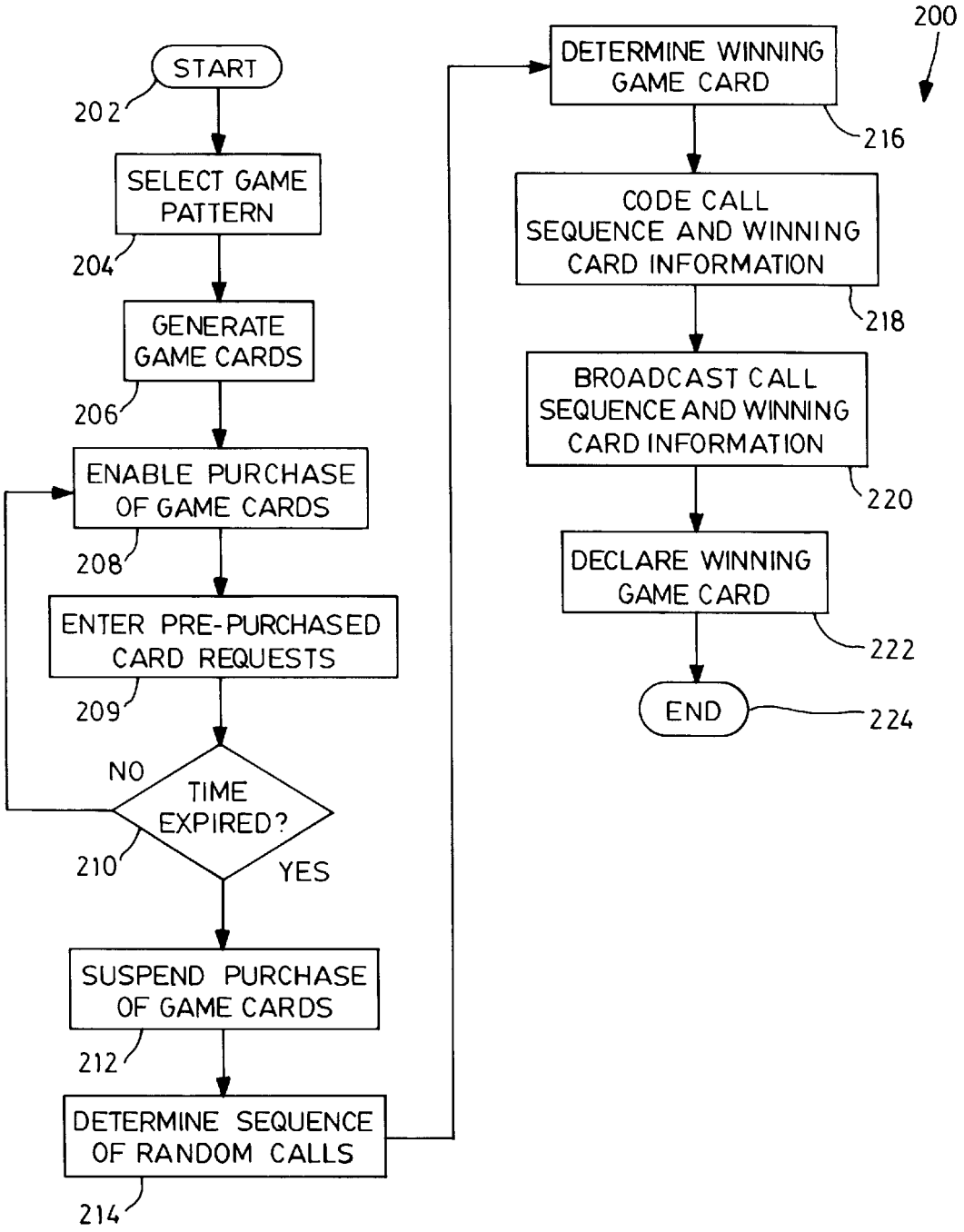
FIG. 2 is a flow chart of one embodiment of a method in accordance with the present invention.

FIG. 2 show a flow chart of one embodiment of a system according to the present invention which is generally indicated by reference numeral 200. The flow chart starts at block 202 and proceeds to block 204 at which a bingo game pattern is selected. While the most common bingo game patterns are vertical, horizontal or diagonal lines, many other patterns such as a letter may be selected as the winning pattern for a particular game. Once a pattern is selected, the next step is to generate a set of game cards at block 206, for example a set of 30,000 or so. Next, at block 208, the game cards are made available for on-line selection or purchase through the internet 106. In an alternate embodiment, it will be appreciated that a pre-existing set of cards may be separately generated or acquired and made available to the system to allow the cards to be purchased at block 208. It will also be appreciated that the cards for a game may be developed independent of the winning pattern and that the winning pattern(s) may be selected once the cards have been acquired as generated. It will also be appreciated that the cards may be generated as orders are received. Furthermore, it will be appreciated that players may have cards selected for them upon purchasing a specified quantity of cards for a specified game. In another embodiment, players may also pre-purchase cards or a specified quantity of cards prior to a game. Such pre-purchased cards would then be automatically entered in the game at block 209.

In order to limit the waiting period for all players and conduct a game in a reasonable time, a time limit is preferably set for permitting purchases of game cards. At block 210, if the time limit for purchasing game cards has expired, the purchase of any further game cards is suspended at block 212. If the time limit has not yet expired, clients may continue to make purchases at block 208. Alternatively, or in addition, the cards may be made available for on-line purchase and the game will only commence once a preset number of cards have been sold.

After the purchase of game cards has been suspended at block 212, a sequence of random calls is generated at block 214 and the winning card is determined at block 216. For example, 75 numbers may be generated between 1 and 75, but this will vary according to the game. This sequence of random calls generated at block 214 is then applied to all of the game cards purchased before the time expiry at block 210, and a winning card is determined at block 216 when one or more of the purchased game cards matches the game pattern selected at block 204. In the case of a standard bingo game, the card or cards which first match the generated numbers are the winners. If all the numbers are generated before comparing the purchased cards to the generated numbers, then the numbers are preferably applied sequentially as in a standard bingo game until the winning card or cards are determined. Alternately, the numbers may be applied to the cards as they are generated until the winning card or cards are determined.

The calls are not transmitted as they are generated at block 214. Rather, as explained further below, the entire call sequence is transmitted, and more preferably the transmitted information is first coded at block 218 and this coded information is then transmitted at block 220 to all of the players on the remote client computers 104*a*–104*c*. The game is replayed to conclusion and a winning game card is declared at block 222 before ending at block 224. The system is described in detail further below.

It will be appreciated that transmission may be by a server initiated broadcast from the game server 102 to each receptive game client computer 104 or, alternatively, client initiated polling from each client computer 104. In the latter form of transmission, at certain events during a game, the game server 102 will update the game status and that status information is then made available on the server to be retrieved by a client initiated request or transaction, Thus, in the client polling mode, the game server 102 is not responsible for maintaining communication with all of the game client computers 104.

Figure 3:
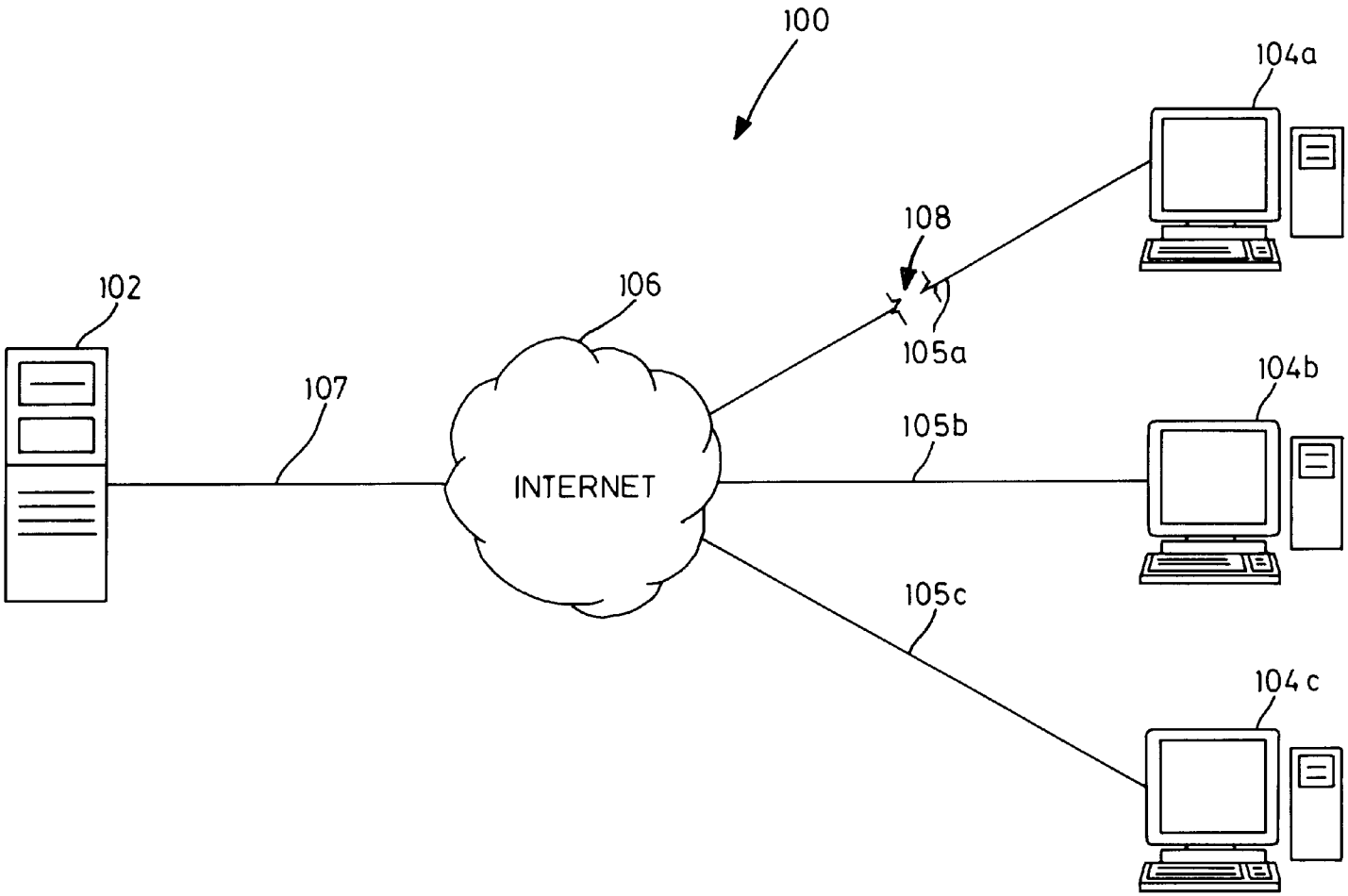
FIG. 3 shows the schematic diagram of the system of FIG. 1 in which one of the game client computers is disconnected from the network.

Now referring to FIG. 3, the schematic shown in FIG. 1 is repeated but the connection 105*a* of remote client computer 104*a* is shown to be disconnected at 108. This disconnection may occur for any number of reasons, for example, when connections are dropped because a client's dial-up connection to their ISP times out. In other cases, ISP network problems inhibit or prevent network traffic from reaching their destinations. Yet another problem is system hang-ups on the remote client's computer 104*a* caused by software conflicts, etc. It has been determined by the applicant that a system hang-up will occur about 0.001% of the time, or one in every one thousand games played. Other problems include internet routing problems and socket errors which may result in a poor or non-functioning internet connection. Thus, in a typical game, the likelihood of at least one player being disconnected during play may be significant.

Still referring to FIG. 3, if the disconnection at 108 occurs during a live bingo game transmission in accordance with the prior art, the player on remote game client computer 104*a* would normally be dropped from the game, and possibly lose the chance of winning even if the player would have otherwise won the game. Furthermore, a player with a slow network connection may not be able to respond fast enough to win a game even if the player has a winning card. However, in the system and method according to the present invention, as the random sequence of calls is generated at block 214 and the winning game card is determined at block 216 prior to any transmission at block 220, the player on remote game client computer 104*a* would win regardless of any disconnection during play, and regardless of any relative disadvantage in terms of connection speed and reliability. The disconnected player could be identified from a player profile which is on file or from information provided at the time of purchase of the card for the game. If the player has an account, then the disconnected player's winnings may be credited to their account.

Figure 4:
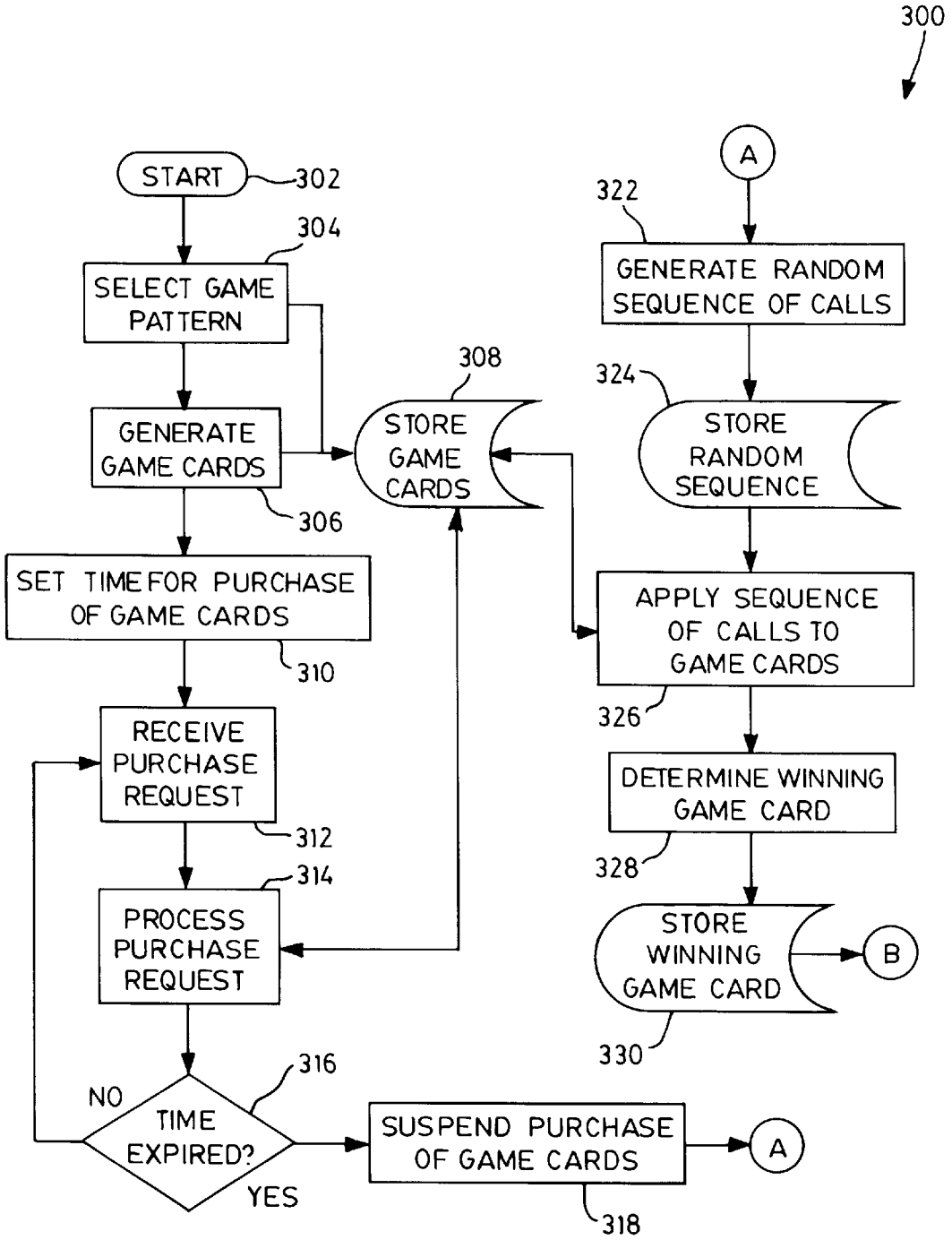
FIG. 4 is a flow chart of one embodiment of a game server system in accordance with the present invention.

Now referring to FIG. 4, a flow chart of one embodiment of a system according to the present invention is shown and generally indicated by reference numeral 300. The system 300 starts at block 302 and includes a game selector module 304 for selecting a game pattern. The game pattern may be selected at random or rotated on a regular basis from a set of predetermined game patterns. The system 300 further includes a game card generator module 306 for generating game cards. The generated game cards may be stored on a storage device 308 for later retrieval. Alternately, separately generated or acquired game cards may be input directly to storage device 308. The system 300 may include a time selector module 310 for selecting the time for allowing purchases of game cards. The system 300 further includes an order receiving module 312 for receiving an order from a remote client computer 104*a*–104*c* (FIG. 1). The system 300 also includes an order processor module 314 for processing the purchase order. The processor module 314 is able to access the generated game cards on storage device 308 and provide them to the purchaser. The purchased cards, or information identifying them, may be stored in storage device 308 or another storage device. The system 300 may further include a timer 316 for determining whether the time for allowing purchases of game cards has expired. If so, then the purchase of further game cards is suspended at block 318. The system 300 further preferably includes a random number generator module 322 for generating a random sequence of calls. The sequence of calls may be stored in a storage device 324 for later retrieval. The system further includes a call application module 326 for applying the sequence of calls to the purchased game cards stored on e.g. storage device 308, and includes a winning card identification module 328 for identifying the winning card. The winning card results may be stored on a storage device 330 for later retrieval.

Figure 5:
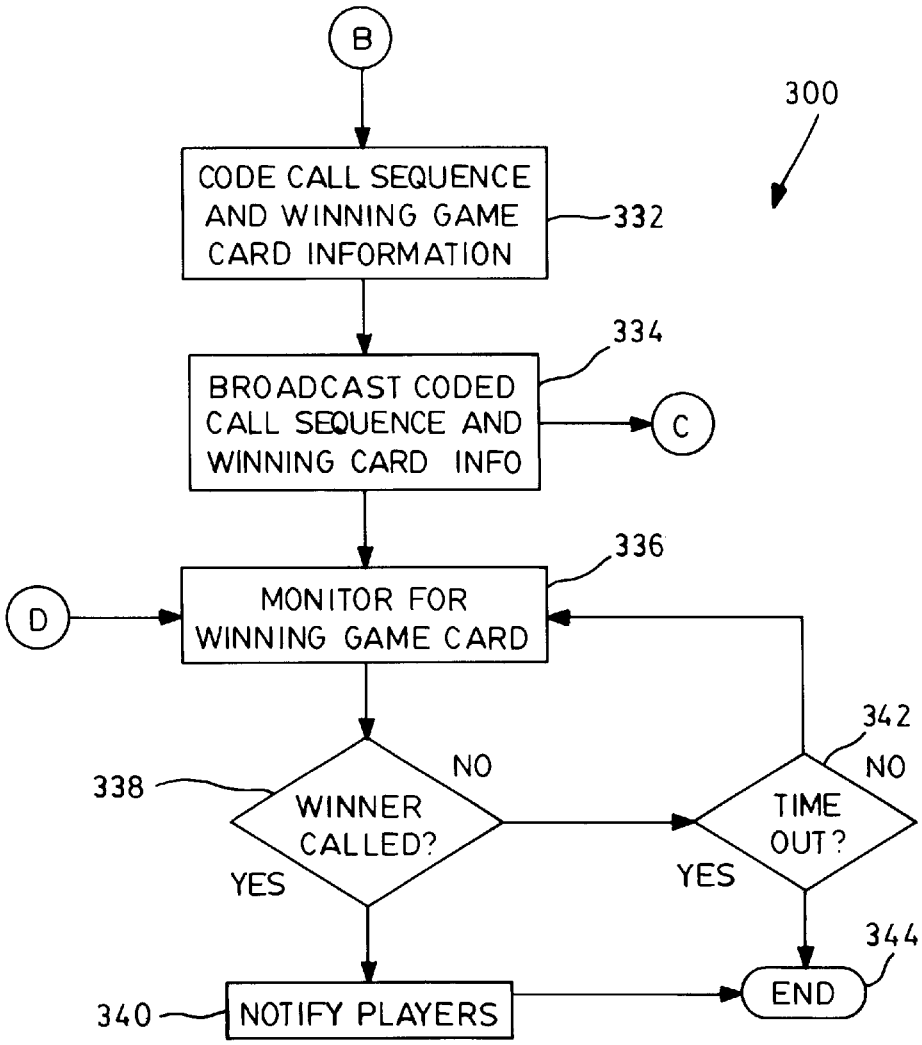
FIG. 5 is a continuation of the flow chart shown in FIG. 4.

Now referring to FIG. 5, in a preferred embodiment, the entire sequence of calls is prepared for transmission by a coding module 332 and then transmitted at block 334 to all of the remote game client computers 104*a*–104*c* (FIG. 1) which purchased cards for the game. The call sequence is preferably coded, or otherwise formatted, so that the result of the game is not accessible prior to the conclusion of the game. It is to be appreciated that, in an alternate embodiment, that data need not be coded prior to transmission.

If there are many remote game client computers 104*a*–104*c* to transmit to, it is possible that the sequence of calls and the winning game card information may not reach all of the computers 104*a*–104*c* at the same time. However, in order to give the appearance of a game played in real time, the start of the sequence of calls can be synchronized by sending a start signal from the server 102. The sequence of calls need not be synchronized from computer to computer since reaction time is not a factor in the gaming protocol according to the present invention. The data may be coded to commence the game on a computer 104 once that computer receives all or at least a part of the data.

As will be explained further below, the coded game information is received by the remote game client computers 104*a*–104*c* and the sequence of calls is individually replayed at each remote game client computer 104*a*, 104*b*, 104*c*. The system 300 may include a monitoring module 336 to monitor the progress of a game as it is being replayed individually at each remote game client computer 104*a*–104*c* until a client indicates a winning game card at block 338. The system 300 may verify the winning game card against the winning game card information stored on storage device 330 (FIG. 4). If verified, then a winner is declared and the system 300 may notify all of the remote game client computers 104*a*–104*c* at block 340 before ending at block 344.

Alternatively, as the coded game information sent to each remote client computer 104*a*–104*c* includes the sequence of calls and the identity of the winning game card information, the system 300 may include a time out module 342 which determines whether the sequence of calls should have been completed, and even if the remote game client computer 104*a* that purchased the winning game card is disconnected from the game server 102 (FIG. 3), the other players may be notified at block 340 and the game is ended at block 344. In another embodiment, the notification of the winning game card may be automatically provided at the completion of the call sequence on each remote game client computer 104*a*–104*c*, regardless of whether or not the remote game client computer 104*a*–104*c* is connected to the server 102. Thus, even in the event of disconnection from the network, the player holding the winning card will always win the game, and will always receive notification of the win. Thus, all of the players are ensured a fair game regardless of the speed and reliability of their network connection.

Figure 6:
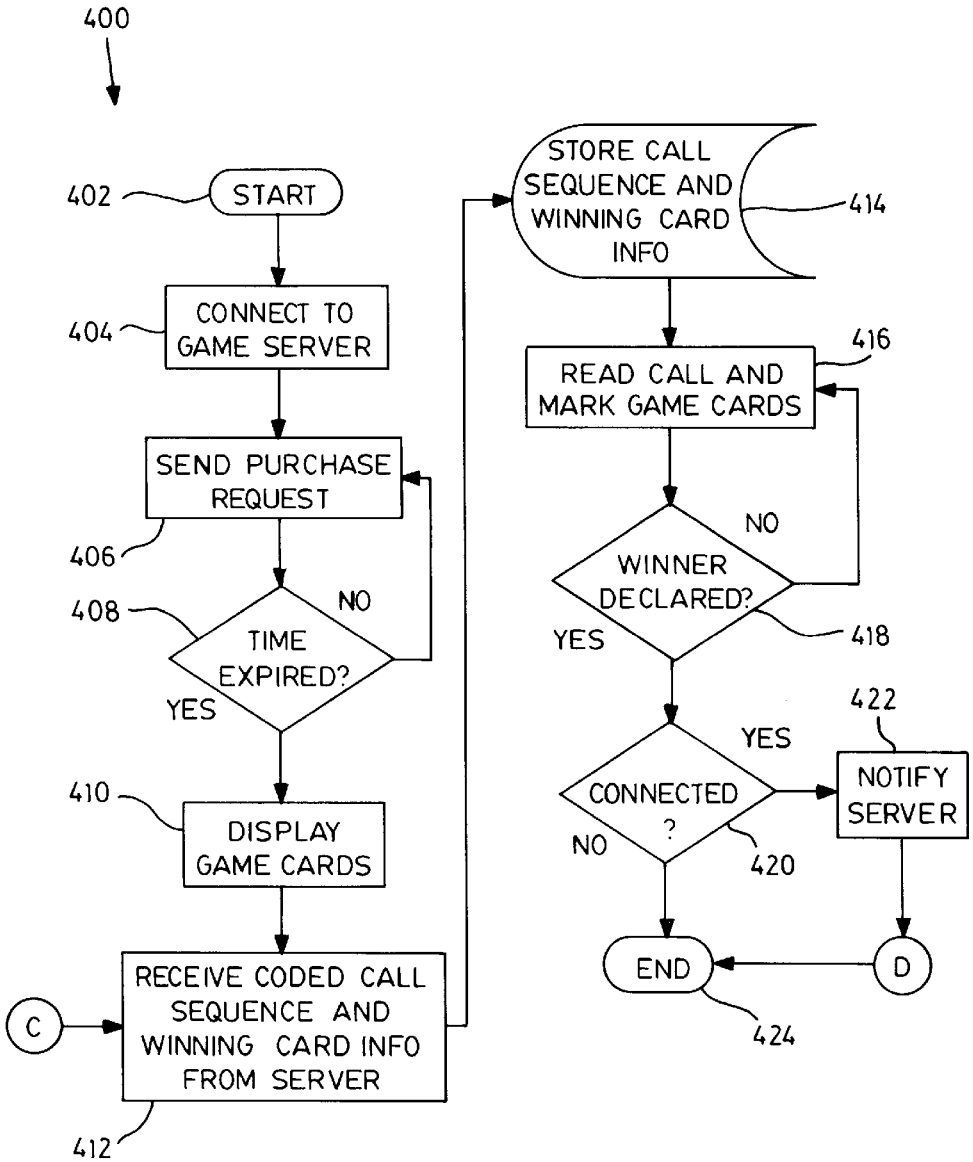
FIG. 6 is a flow chart of a game client's interaction with the system in accordance with the present invention.

FIG. 6 is a flow chart of a schematic 400 showing by way of example interaction of a player on a remote game client computer 104*a*–104*c* (FIG. 1) with the system 300 in accordance with the present invention. The player interaction starts at block 402, and proceeds to block 404 where the game player connects to the game server 102 (FIG. 1). The player proceeds to send a purchase request 406 to purchase one or more game cards until e.g. the purchasing time limit expires at block 408. When the time limit expires, the game cards purchased by the player are displayed at block 410 on a computer display on the remote game client computer 104. The player then receives at block 412 the coded call sequence and winning card information transmitted from the server at block 334 (FIG. 5). The player need not be aware that this information is being downloaded and, for all intents and purposes, may believe that the game is being played in real time. The downloaded call sequence and winning card information is then stored on a local storage device 414 (e.g. computer 104) and decoded at block 416 by client software installed on the remote game client computers 104*a*–104*c*.

The client software then calls the sequence at, e.g., predetermined time intervals as in a standard bingo game at block 416 until a winning card is declared at block 418. The player may have the option of marking the game cards automatically via the client software, or marking the game cards manually by means of an input device such as a mouse or a touch screen. If manual game card marking is permitted, the client software may provide a further option of allowing or disallowing wrong markings. If wrong markings are allowed, then it is possible that a player may erroneously declare a winning card. In this event, the player may indicate a winning card but this will not be validated by the server or by the winning card information already downloaded on the remote game client computers 104*a*, 104*b*, 104*c*. For example, the software installed on computer 104 preferably checks the supposed winning card against the numbers called and will advise the player that the card is not a winning card and the and the game will then recommence as in a standard bingo game.

If the player happens to be connected to the game server 102, then the player may at block 422 notify the server 102 of a winning card before the game ends at block 424. The player may indicate a winning game card to the server 102 by means of a key or clicking on an icon, for example. However, as explained earlier, regardless of whether a player notifies the game server, when the selected game pattern is matched, the winner is declared at block 414 and the game ends at block 424. Thus, if the player with the winning card is disconnected during play, or even if another player erroneously declares a winning game card, the player with the winning game card will still win, and be notified of the win, and the game will end.

While a particular embodiment of a method according to the present invention has been shown and described, it would be obvious to those skilled in the art that various other changes and modifications can be made without departing from the spirit and scope of the invention. It is therefore intended to cover in the intended claims all of such changes and modifications that are within the scope of this invention.

I claim:

1. A method of operating a bingo game using a game server on a network and a plurality of remote game client computers, comprising:

(a) providing a plurality of unique game cards and enabling a plurality of players to each purchase at least one unique game card by using a remote game client computer, at least one purchased card is a winning game card;

(b) suspending the purchase of game cards;

(c) after step (b), generating numbers to obtain a sequence of calls;

(d) applying the sequence of calls to each purchased game card and identifying the at least one winning game card;

(e) after step (d), transmitting the sequence of calls applied in step (d) to each remote game client computer which has been used to purchase at least one game card; and, (f) on each remote game client computer, repeating the sequence of calls applied in step (d) until the at least one winning game card is identified.

2. The method according to claim 1 further comprising including with the transmitted sequence of calls the identity of the at least one winning game card.

3. The method according to claim 2 further including the step of coding the sequence of calls and the identity of the at least one winning game card prior to transmitting said sequence of calls and identity of the at least one winning game card to each remote client computer.

4. The method according to claim 1 further including the step of coding the sequence of calls prior to transmitting said sequence of calls to each remote client computer.

5. The method according to claim 1 wherein step (f) comprises repeating each number in the sequence of calls at specified intervals until the at least one winning game card is identified.

6. The method according to claim 2 wherein in step (e), the transmitting of the sequence of calls and the identity of the at least one winning game to said remote game client computers is asynchronous.

7. The method according to claim 6 further comprising the step of synchronizing the start of the sequence of calls on said remote game client computers with a start signal issued by the game server.

8. The method according to claim 1 wherein in step (e), the transmitting of the sequence of calls to said remote game client computers is asynchronous.

9. The method according to claim 8 further including the step of synchronizing the start of the sequence of calls on said remote game client computers with a start signal issued by the game server.

10. The method according to claim 1 further including the step of selecting a game pattern and generating a plurality of game cards.

11. The method according to claim 10 wherein the plurality of game cards are first generated before the purchase of the cards is enabled.

12. The method according to claim 10 wherein the game cards are generated as they are purchased.

13. A system for simulating a real time bingo game on a network, including a game server connected to a network and comprising:

(a) a purchase order processor for processing purchase orders for game cards from remote game client computers and suspending the purchase of game cards, wherein at least one of the purchased game cards is a winning game card;

(b) a generator for generating a sequence of calls;

(c) a processor for applying the sequence of calls to purchased game cards and determining the at least one winning game card; and (d) a network connection for transmitting at the same time the sequence of calls to at least one remote game client computer for repeating the sequence of calls until the at least one winning game card is identified.

14. The system according to claim 13, further including a storage device for storing at least one of the purchased game cards, the sequence of calls, and the at least one winning game card information.

* * * * *